United States Patent [19]

Peterson

[11] 4,163,443

[45] Aug. 7, 1979

[54] LATCH MECHANISM FOR AN OVEN DOOR

[75] Inventor: Stanley O. Peterson, Wisconsin Rapids, Wis.

[73] Assignee: Preway, Inc., Wisconsin Rapids, Wis.

[21] Appl. No.: 824,847

[22] Filed: Aug. 15, 1977

[51] Int. Cl.[2] ..... F24C 15/02

[52] U.S. Cl. ..... 126/197; 292/110; 292/216; 292/DIG. 69

[58] Field of Search ..... 292/DIG. 69, DIG. 49, 292/110, 216, 280; 219/393, 396, 397, 398; 403/316, 353; 126/197

[56] References Cited

U.S. PATENT DOCUMENTS

| | | | |
|---|---|---|---|
| 924,334 | 6/1909 | Fouch | 403/353 |
| 3,540,767 | 11/1970 | Siegel | 292/210 |
| 3,757,084 | 9/1973 | McLean et al. | 219/413 |
| 3,831,580 | 8/1974 | McLean | 126/197 |
| 3,894,214 | 7/1975 | Staples | 219/394 |
| 3,968,983 | 7/1976 | Heit et al. | 292/201 |
| 4,013,312 | 3/1977 | DeWeese | 292/113 |

*Primary Examiner*—John J. Camby
*Assistant Examiner*—Larry I. Schwartz
*Attorney, Agent, or Firm*—Wegner, Stellman, McCord, Wiles & Wood

[57] ABSTRACT

A door latch mechanism, mountable in an oven for engagement with an oven door, includes a base, a latch plate carried on the base by a pair of flanged guide rollers carried on the base and cooperating with a pair of guide slots in the latch plate, and a yieldable over-center urging means pivotally engaged with the latch plate and reciprocably received by a support on the base, the latch plate being carried by the base for movement between an extended position and a retracted position corresponding to open and closed positions, respectively, of the oven door. The mechanism, in one embodiment, further includes a lock for securing the latch plate in its retracted position and a thermally responsive interlock for retaining the lock in a locked position when the oven is operative.

6 Claims, 5 Drawing Figures

134
132
126
130
124
122
100
128
102
116
103
104
106
114
118
120
113
140
53
51
59
66
90
85
92
82
80
88
40
64
94
60
52
54
72
74
70
65
50
28
44
42
26
14
12

12
28
26
14
44
102
74
70
140
144
142
50

LATCH MECHANISM FOR AN OVEN DOOR

BACKGROUND OF THE INVENTION

1. Field of the Invention

This invention relates generally to oven door latches and, more specifically, this invention relates to door latches usable in microwave or self-cleaning ovens.

2. Description of the Prior Art

It is well known in ovens to have a latch mechanism which can be locked to prevent accidental or inadvertent opening of an oven door. Such latch mechanisms are especially useful in self-cleaning ovens where it is desirable to prevent opening of the oven door during the high-temperature self-cleaning cycle, and in microwave ovens where it is desirable to prevent release of microwave radiation.

Prior latch constructions have been complex and have been characterized by many pivotally interconnected links and locking members. Such constructions have been bulky, time consuming and difficult to assemble, and costly.

SUMMARY OF THE INVENTION

It is an object of the invention to provide an oven door latch which has the advantages of low cost, few parts, and ease of assembly.

In accordance with the foregoing object, the present invention resides in the provision of an oven door latch useable with various types of ovens, the door latch having a latch plate carried on a base member by guide members engaged with guide slots in the latch plate, and yieldable urging means engageable with the latch plate and with a support on the base member to retain the latch plate in a retracted or an extended position relative to the base member, the positions corresponding to open and closed positions, respectively, of the oven door.

The guide slots have enlarged portions which facilitate assembly and, with the yieldable urging means and an abutment on the base member, the slots act to prevent movement of the latch plate to an assembly position during use of the mechanism.

DETAILED DESCRIPTION OF THE PREFERRED EMBODIMENT

Figure 1:
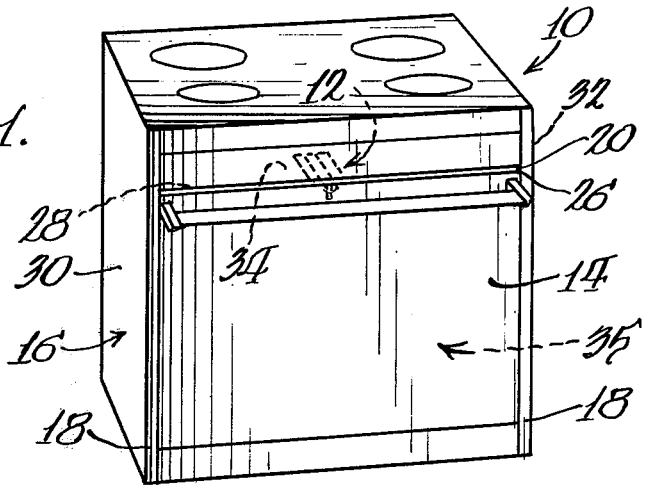
FIG. 1 is a reduced scale, perspective view of an oven embodying the door latch mechanism of the invention, with the door latch mechanism shown in phantom line.

FIG. 1 illustrates an oven 10 embodying a locking door latch mechanism 12. The oven 10 is an oven with self-cleaning capabilities, but it is to be understood that the basic structure applies equally to microwave ovens.

The oven 10 includes a door 14 hinged at its bottom to a frame 16, as at points 18. The door 14 closes at an interface 20 formed by a rear wall 26 of the door 14 and an abutment surface 28 extending transversely of two side walls 30 and 32 of the oven frame 16. The frame 16 further includes a top wall 34, rear walls and a floor (not shown). An oven chamber 35 is bounded by the walls 30, 32 and 34, the floor and the rear wall 26 of the door 14.

Figure 2:
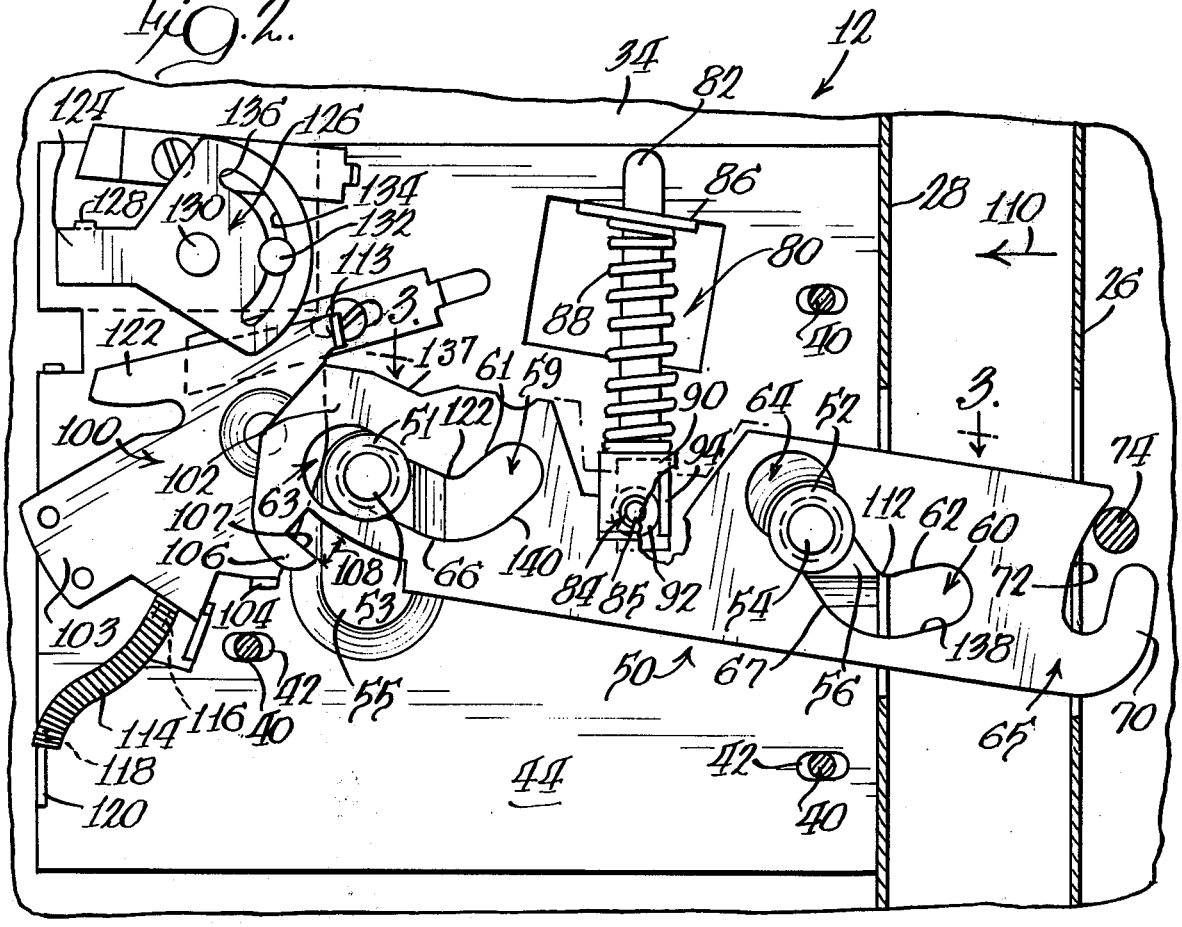
FIG. 2 is a fragmentary top plan view of the door latch mechanism and oven of FIG. 1 with the oven door open and the mechanism in an extended position.

Referring now to FIG. 2, the latch mechanism 12 is viewed from above with overlying parts of the oven omitted for clarity. The latch mechanism 12 is secured to and overlies the upper wall 34 of the oven chamber 35, as by a plurality of studs 40 extending from the wall 34 through slots 42 in a base member in the form of a plate 44. The slots 42 allow limited transverse positioning of the base plate 44 with respect to the abutment surface 28.

The base plate 44 carries a latch plate 50 for movement between an extended position (shown in FIG. 2) corresponding to a release position for the door 14, and a retracted position (shown in FIGS. 4 and 5) corresponding to the closed position of the door 14. The latch plate 50 is carried by a pair of flanged guide rollers 51 and 52, mounted for rotation on a pair of posts 53 and 54 upstanding from raised sections 55 and 56 of the base plate 44.

Each guide roller 51 and 52 engages the latch plate 50 in a respective guide slot 59 and 60 formed in the plate 50. Each guide slot 59 and 60 has a dog-leg shape and includes a respective cam surface 61 and 62 and an enlarged keyhole slot 63 and 64 at the end of each slot 59 and 60 farthest from an end 65 of the plate 50 closest to the door 14.

The diameter of each keyhole slot 63 or 64 is slightly greater than the diameter of the flanges of the corresponding guide roller 51 or 52 to facilitate assembly of the latch plate 50 on the base plate 44. During assembly, the latch plate 50 may be mounted for carriage on the base plate 44 by placing each keyhole slot 63 and 64 over the corresponding guide roller 51 and 52 for engagement of the straight segments 66 and 67 of the cam surfaces 61 and 62 with the rollers 51 and 52.

The end 65 of the latch plate 50 includes a hook 70 and an abutment surface 72 extending transversely of the longitudinal plane of the latch plate 50. The hook 70 is sufficiently wide to capture a post 74 carried by the oven door 14.

A yieldable over-center urging means, generally designated 80, includes an arm 82 pivotally engaged with the latch plate 50 generally centrally thereof at a pivot point 84. The pivot point 84 preferably comprises a notch (not shown) in the latch plate 50 engageable with a pin 85 depending from the arm 82.

The end of the arm 82 farthest from the pivot point 84 is reciprocably received in a support 86 struck out of the base plate 44. A helical spring 88 is carried about the arm 82, as by the support 86 and by an abutment 90 formed on the end of the arm 82 closest to the pivot point 84.

Figure 3:
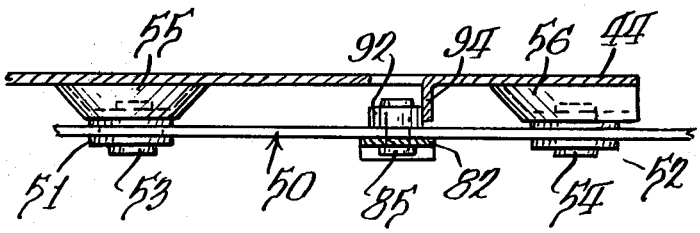
FIG. 3 is a partial vertical sectional view of the door latch mechanism of FIG. 2 taken approximately along line 3—3 of FIG. 2.

FIG. 2 shows the latch plate 50 in its fully extended position, with each guide roller 51 and 52 adjacent its associated keyhole slot 63 or 64. Further travel of the latch plate 50 to the right (as viewed in FIG. 2) is prevented by engagement of an abutment stop 92, carried by the pin 85 and depending downwardly from the arm 82, with a stop flange 94 struck fron the base plate 44. The abutment stop 92 and the flanges 94 are seen in cutaway in FIG. 2 and are also seen in FIG. 3. Engagement of the abutment stop 92 against the flange 94 prevents the guide rollers 51 and 52 from entering the keyhole slots 63 and 64 and thereby prevents disengagement of the cam surfaces 61 and 62 from the guide rollers 51 and 52.

A lock means 100 is pivotally secured to the base plate 44 in proximity to an end 102 of the latch plate 50 farthest from the oven door 14. The lock means 100 includes a locking arm 103 with a tab 104 engageable with a hook 106 on the latch plate end 102 when the latch plate 50 is in its retracted position (shown in FIG. 3), but not when the latch plate 50 is in its extended position. The hook 106 has a tab-receiving opening 107 of a width 108 sufficient to capture the tab 104 even if the latch plate 50 is not in its fully retracted position.

The lock means 100 is positionable, as by the arm 103 which is adapted to be connected to a lever means (not shown) operable by the user of the oven 14, or by other means. A tab 113 extends upwardly from the arm 103 for abutment with the latch plate 50, when extended, to retain the lock means 100 in its unlocked position. An elongate spring 114 engages the locking arm 103, as by a boss 116, and engages the base plate 44, as by a boss 118 extending from a tab 120 struck from the plate 44. The spring 114 acts as an over-center urging means to retain the locking arm in either of its locked or unlocked positions.

The lock means 100 includes a hook 122 which, when the lock means 100 is in its locked position, is engageable by a thermally responsive interlock means 126. The thermally responsive interlock 126 comprises an arm 124 retained for rotation on a rotatable spindle 30. The arm 124 includes a downwardly extending tab 128 for engagement with the hook 122.

The spindle 130 extends through the base plate 44 and is connected to a thermally responsive element (not shown), such as a bimetallic strip, in the heating chamber 35. A flanged stud 132 is fixed to the spindle 130 by a radial arm (not shown) for rotation in a slot 134 of the arm 124.

Figure 4:
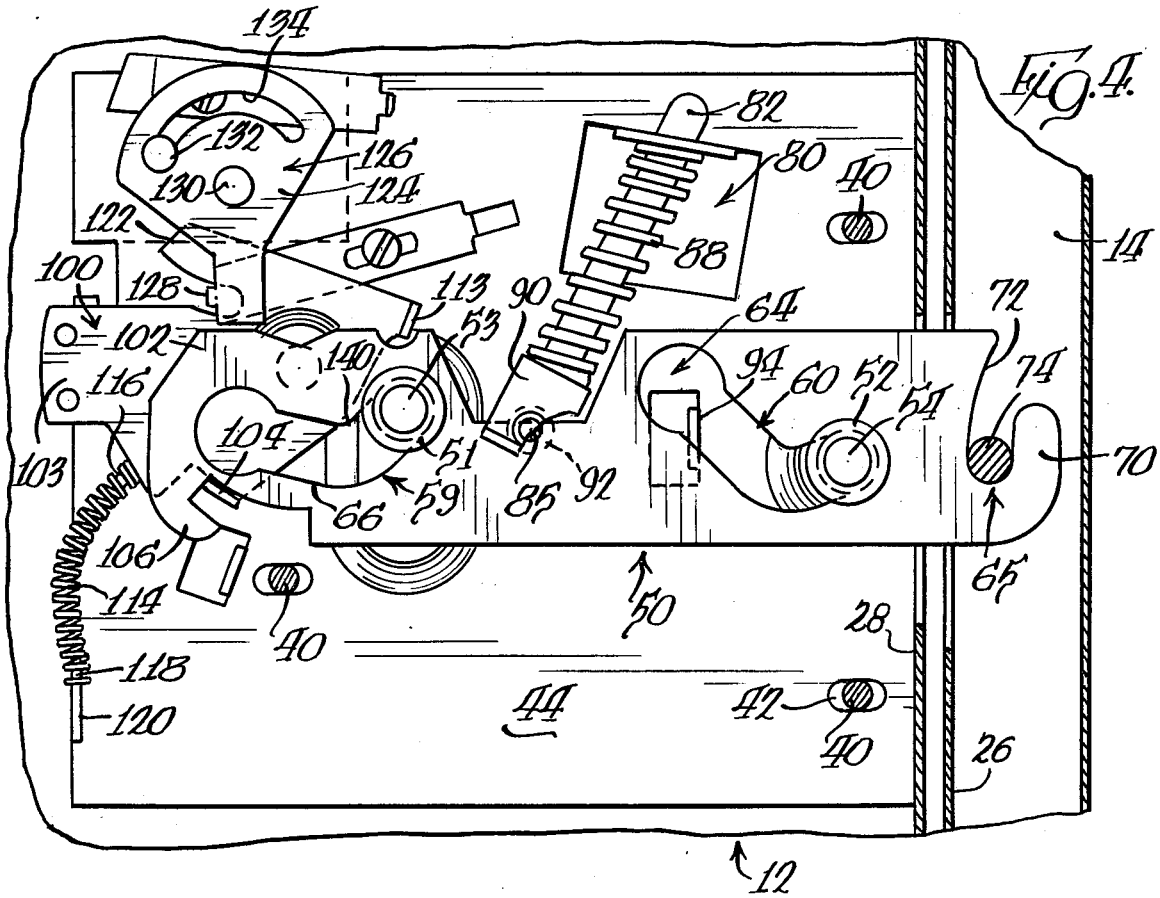
FIG. 4 is a fragmentary top plan view of the oven and door latch mechanism of FIG. 2, with the oven door closed and the mechanism in a retracted position.

Upon heating of the oven chamber, the bimetallic strip expands and causes rotation of the spindle 130 and the stud 132 for engagement with the arm 124 at an abutment 136 of the slot 134. Continued heating of the bimetallic strip results in sufficient rotation of the arm 124 to bring the tab 128 into engagement with the hook 122, as shown in FIG. 4.

The latch plate 50 is shown in its extended position in FIG. 2, and all of the elements of the mechanism 12 are shown in positions corresponding to the extended, unlocked position of the latch plate 50. The locking operation of the latch plate 50 is now described in detail.

On closing the door 14, the door 14 is closed in the direction of the arrow 110, and the post 74 is brought into abutting contact with the abutment surface 72. The post 74 forces the latch plate 50 to travel to the left in a pattern determined by the shape of the cam surfaces 61 and 62.

As leftward force is applied to the surface 72, the rightmost guide slot 60 directs the end 65 in a generally leftwardly and upwardly diagonal direction in the plane of FIG. 2 until the guide roller 52 reaches an elbow 112 of the cam surface 62. The length of the segment 67 and the acute angle between the segment 67 and the surface 72 are sufficiently great to insure that the end 65 travels in an arc and that the post 74 is captured by the hook 70.

The diagonal motion of the end 65 has a rotational effect on the end 102. The guide slot 59 guides the end 102 in a generally leftward direction which, in combination with the above described rotational effect, causes the end 102 to follow a generally parabolic path. A recess 137 in the end 102 is provided to avoid contact with the tab 113 on the lock means 100 during door closure.

After the guide roller 51 reaches the elbow 122 of the guide slot 59, the end 102 travels downwardly relative to the post 53 in the plane of FIG. 2. The yieldable urging means 80 provides resistance to the leftward movement of the latch until the guide rollers 51 and 52 simultaneously reach the elbows 122 and 112 of the respective guide slots 59 and 60, after which point the urging means 80 urges the latch plate 50 to the left of FIGS. 2 and 4. The length of a segment 138 of the cam surface 62 and its angle relative to the wall 28 are sufficient to allow the urging means 80 to exert the necessary pushing force toward the left of FIG. 2.

Referring now to FIG. 4, the configuration of the door latch mechanism 12 in its locked position is illustrated. The urging means 80 retains the guide slots 59 and 60 snugly against the guide rollers 51 and 52. The post 74 of the oven door 14 is tightly captured by the hook 70 and the locking arm 103 of the lock means 100 has been manually rotated to effect engagement of the tab 104 with the hook 106. The lock means 100 is retained in its locked position of FIG. 4 by the spring 114.

The thermally responsive interlock 126 is also shown in its locked position. In response to a temperature increase in the oven chamber generated by the self-cleaning cycle, the thermally responsive bimetallic strip has effected counterclockwise rotation of the spindle 130 and the stud 132 and, hence, the interlock arm 124. The tab 128 engages the hook 122 of the lock means 100. The thermally responsive interlock may not be repositioned from the locked position of FIG. 4 until the oven chamber has become cool after the self-cleaning cycle is terminated.

Should a user attempt to open the oven door, the post 74 will apply a rightwardly directed force against the hook 70. The slope of a segment 140 of the cam surface 66 relative to the path of the post 74 is sufficiently great, in combination with the urging means 80, to provide resistance to rightward travel of the latch plate 50. Rightward movement of the latch plate 50 will be prevented by abutment of the hook 106 if the tab 104 of the lock means 100 is in its locked position.

If not for the thermally responsive interlock, however, the lock means 100 would be manually disengageable from the hook 106, allowing rightwardly directed force against the hook 70 to move the latch plate 50 toward the right. The interlock 126, however, prevents manual or other rotation of the lock arm 110 to preclude inadvertent unlocking of the latch means and opening of the door 14.

Figure 5:
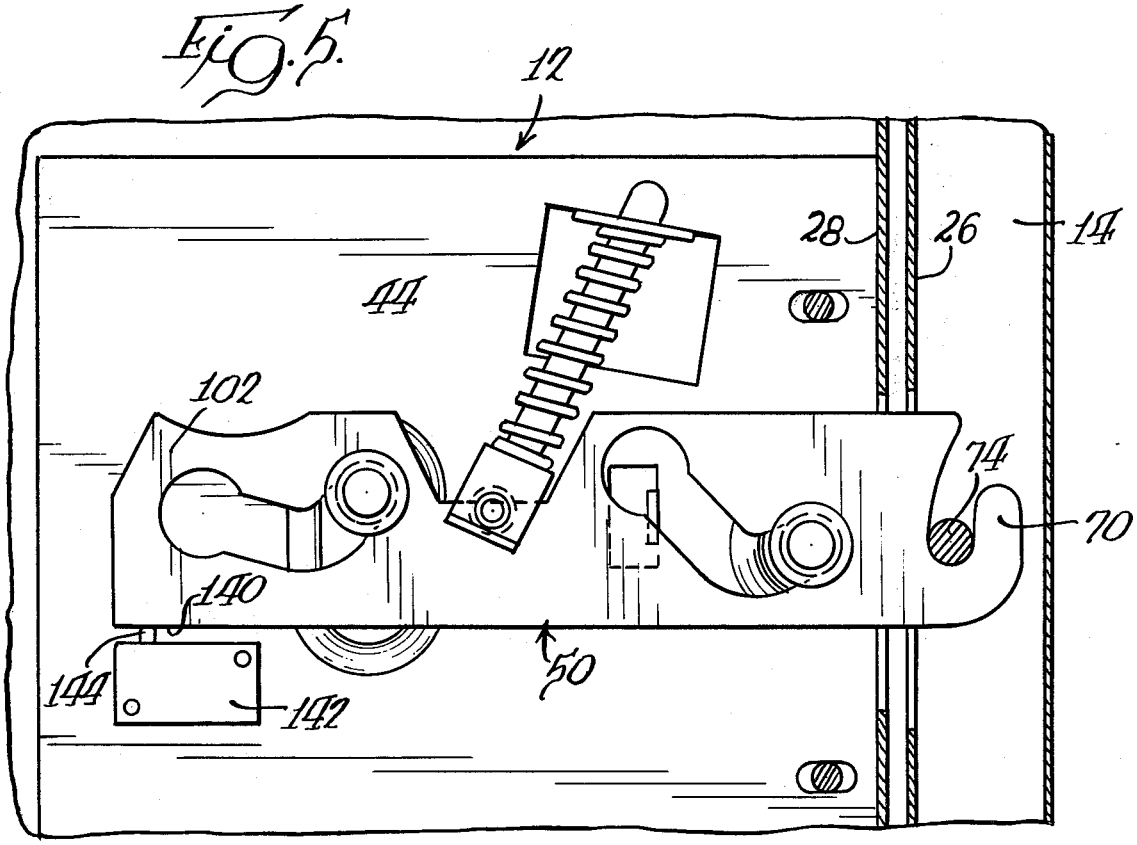
FIG. 5 is a fragmentary top plan view of another embodiment of the door latch mechanism of the invention in place on a microwave oven with the mechanism in a retracted position with the oven door closed.

Referring now to FIG. 5, the door latch mechanism is shown for use with a microwave oven. The mechanism of FIG. 5 does not include the thermally-responsive interlock 126, the manually lockable means 100, nor the hook 106 of FIGS. 2–4. An abutment face 140 is formed on the end 102 of the latch plate 50.

A signalling means 142 is secured to the base plate 44 for engagement with the abutment face 140 when the latch plate 50 is in its retracted position. The signalling means 142 may comprise a mechanical, electrical or other interlock which, when not actuated, prevents production of microwave radiation by the oven. The oven may be activated only when the signalling means 142 is actuated.

When the latch plate 50 is in its extended position, the signalling means 142 is deactuated. In the retracted position of the latch plate 50, the abutment face 140 engages the actuating means 144 and thereby actuates the signalling means 142. Therefore, when the door 14 is closed, the oven may be activated. Should the door 14 inadvertently be opened, the post 74 will provide a rightwardly directed movement against the hook 70 to force the end 102 of the latch plate 50 away from the actuating means 144, thereby deactuating the signalling means 142 and deactivating the oven.

It will be apparent from the foregoing detailed description that an important feature of the invention is the ease of assembly of the latch mechanism 12. With the urging means 80 disengaged from the latch plate 50, the keyhole slots 63 and 64 may be aligned with the respective guide rollers 53 and 54 to engage the guide rollers 53 and 54 with the respective cam surfaces 61 and 62. The arm 82 of the urging means 80 may then be received by the support 86 and the pin 85 engaged with the notch of the latch plate 50 to complete assembly.

After assembly, interaction of the abutment stop 92 and the flange 94 prevents the latch plate 50 from reaching an assembly position by preventing the keyhole slots 63 and 64 from engaging the guide rollers 51 and 52.

I claim:

1. A door latch mechanism mounted within an oven and engageable with a door of said oven for locking thereof, comprising:

a base plate with a support projecting therefrom and a pair of flanged guide rollers;

a latch plate carried by said base plate for movement between extended and retracted positions corresponding to open and closed positions, respectively, of said oven door, said latch plate having a pair of guide slots spaced along the length thereof, each said guide slot engaged by one said guide roller and including an enlarged portion of a diameter greater than that of its corresponding guide roller, each said roller engaging a guide slot for guiding said latch plate for movement between said extended and retracted positions; and an over-center spring mechanism carried on said base plate and comprising an arm pivotally engaged with said latch plate and reciprocably received by said support, said arm including an abutment face at an end thereof closest to said latch plate, a spring carried by said arm between said abutment and said support, and an abutment stop carried by said arm and engageable with said stop when said latch plate is in its extended position, whereby said enlarged portions of said guide slots are prevented from engaging said flanged guide rollers, whereby said latch plate is yieldably retained in either said extended position or said retracted position.

2. The door latch mechanism of claim 1 wherein each said guide slot has two angularly related sections and an elbow cooperating with its associated guide roller to impart an arcuate path to said latch plate as said latch plate is moved between said retracted and extended position, one said section of each guide slot being sloped so as to provide resistance to movement of said latch plate from said retracted position to said extended position by urging said plate against the action of said over-center spring mechanism.

3. A door latch mechanism mountable within an oven and engageable with a door of said oven for holding the door closed, comprising:

a base member with a pair of flanged guide rollers;

a latch plate carried by said base member for movement between extended and retracted positions corresponding to open and closed positions, respectively, of said oven door, said latch plate having a pair of guide slots spaced along the length thereof, each said guide slot engaged by one said guide roller for guiding said latch plate for movement between said extended and retracted positions, each said guide slot including an enlarged portion of a diameter greater than that of its corresponding guide roller to permit assembly of said latch plate to said base member, and means effective after assembly to prevent alignment between said enlarged portions and said guide rollers; and yieldable urging means carried on said base member and engageable with said latch plate for yieldably retaining said latch plate in either said extended position or said retracted position.

4. A door latch mechanism mountable within an oven and engageable with a door of said oven for holding the door closed, comprising:

a base member with a pair of flanged guide rollers and a stop projecting from said base member;

a latch plate carried by said base member for movement between extended and retracted positions corresponding to open and closed positions, respectively, of said oven door, said latch plate having a pair of guide slots spaced along the length thereof, each said guide slot engaged by one said guide roller for guiding said latch plate for movement between said extended and retracted positions, each said guide slot including an enlarged portion of a diameter greater than that of its corresponding guide roller, to permit assembly of said latch plate to said base member; and yieldable urging means carried on said base member, said urging means carrying an abutment stop engageable with said stop projecting from said base member when said latch plate is in its extended position, whereby said enlarged portions of said guide slots are prevented from engaging said flanged guide rollers and said latch plate is yieldably retained in either said extended position or said retracted position.

5. A door latch mechanism mountable within an oven and engageable with a door of said oven for holding the door closed, comprising:

a base member with a pair of guide members and a support projecting from said base member;

a latch plate carried by said base member for movement between extended and retracted positions corresponding to open and closed positions, respectively, of said oven door, said latch plate having a pair of guide slots spaced along the length thereof, each said guide slot engaged by one said guide member for guiding said latch plate for movement between said extended and retracted positions, each said guide slot having two angularly related sections and an elbow cooperating with its associated guide member to impart an arcuate path to said latch plate as said latch plate is moved between said retracted and extended positions, one said section of each guide slot being sloped; and yieldable urging means carried on said base member for yieldably retaining said latch plate in either said extended position or said retracted position, said urging means comprising a single arm pivotally engaged with said latch plate and reciprocably received by said support, said arm including an abutment surface at an end closest to said latch plate, and a spring carried by said arm between said abutment and said support, said urging means cooperating with said guide slot sloped sections to resist movement of said latch plate from said retracted position to said extended position.

6. A door latch mechanism mountable within an oven and engageable with a door of said oven for holding the door closed, comprising:

a base member with a pair of guide members and carrying a locking arm and a thermally actuable interlock arm, said locking arm carrying a tab and a hook and said interlock arm carrying a tab engageable with said locking arm hook;

a latch plate carried by said base member for movement between extended and retracted positions corresponding to open and closed positions, respectively, of said oven door, said latch plate having a pair of guide slots spaced along the length thereof, each said guide slot engaged by one said guide member for guiding said latch plate for movement between said extended and retracted positions, said locking arm being rotatable when said latch plate is in its retracted position, said latch plate carrying a hook at one end thereof engageable by said locking arm tab, said rotatable locking arm hook being engageable with said interlock arm tab when said latch plate is in its retracted position and said locking arm is in its locked position and a preset temperature has been reached; and yieldable urging means carried on said base member and engageable with said latch plate for yieldably retaining said latch plate in either said extended or said retracted position.

* * * * *